US011459786B2

(12) United States Patent
LeAnna

(10) Patent No.: US 11,459,786 B2
(45) Date of Patent: Oct. 4, 2022

(54) PIN ANCHORED UMBRELLA BASE

(71) Applicant: David L. LeAnna, Thompsons Station, TN (US)

(72) Inventor: David L. LeAnna, Thompsons Station, TN (US)

(73) Assignee: USEITT, LLC, Pinecrest, FL (US)

( * ) Notice: Subject to any disclaimer, the term of this patent is extended or adjusted under 35 U.S.C. 154(b) by 75 days.

(21) Appl. No.: 16/817,696

(22) Filed: Mar. 13, 2020

(65) Prior Publication Data

US 2020/0208430 A1 Jul. 2, 2020

Related U.S. Application Data

(63) Continuation-in-part of application No. 16/386,252, filed on Apr. 16, 2019, now abandoned.

(60) Provisional application No. 62/818,056, filed on Mar. 13, 2019, provisional application No. 62/658,466, filed on Apr. 16, 2018.

(51) Int. Cl.
*E04H 12/22* (2006.01)

(52) U.S. Cl.
CPC ..... *E04H 12/2269* (2013.01); *E04H 12/2238* (2013.01)

(58) Field of Classification Search
CPC ..... E04H 12/2223; E04H 12/2269
See application file for complete search history.

(56) References Cited

U.S. PATENT DOCUMENTS

| | | | | |
|---|---|---|---|---|
| 1,445,938 | A * | 2/1923 | Farrington | F16B 37/12 52/295 |
| 1,631,227 | A * | 6/1927 | See | E04H 12/2269 248/511 |
| 3,317,168 | A * | 5/1967 | Ziph | E04H 12/2223 248/156 |
| 7,219,872 | B2 * | 5/2007 | Walker | E04H 12/2215 248/156 |
| 9,232,836 | B1 * | 1/2016 | Zaccaro | E02D 5/801 |
| 10,344,496 | B1 * | 7/2019 | Cefalo | E04H 12/2269 |
| 2006/0278772 | A1 * | 12/2006 | Walker | E04H 12/2269 248/156 |

FOREIGN PATENT DOCUMENTS

| | | | | |
|---|---|---|---|---|
| EP | 0641891 | A1 * | 3/1995 | E04H 12/2269 |
| WO | WO-9400657 | A1 * | 1/1994 | E04F 11/1812 |

* cited by examiner

*Primary Examiner* — Noah Chandler Hawk
(74) *Attorney, Agent, or Firm* — Miller & Martin PLLC

(57) ABSTRACT

An anchored umbrella base is provided with a screw-in base member threaded to an anchor and protruding through a dome to receive a lower umbrella pole.

20 Claims, 14 Drawing Sheets

PIN ANCHORED UMBRELLA BASE

The present application claims priority to U.S. Provisional Application No. 62/818,056 filed Mar. 13, 2019 and is a continuation in part of U.S. application Ser. No. 16/386,252 filed Apr. 14, 2019, which claims priority to U.S. Provisional Application No. 62/658,466 filed Apr. 16, 2018.

FIELD OF THE INVENTION

The present invention relates to umbrella bases, and particularly a fixed position anchor for an umbrella base.

BACKGROUND OF THE INVENTION

Umbrellas are widely used to provide protection from the sun or the elements. Since umbrellas are nearly invariably used outside, it is desirable that the umbrella components provide stability when subjected to at least light winds and breezes, and even heavier weather when possible. It is also desirable that adjustments to umbrellas be subject to rapid implementation so that umbrellas can be opened and extended quickly when needed and collapsed and retracted when it is desired to strike the umbrella, as to take it indoors.

Unless securely fastened, an umbrella can tip over or be blown down which may damage the umbrella or nearby people or property. In an effort to provide stable base for umbrellas, numerous techniques have been employed. Techniques have included planting the lower pole of the umbrella in sand or ground, the use of a variety of bases and base attachments such as the mounting system in U.S. Pat. No. 9,127,475, or weighted bases such as described in U.S. Pat. No. 3,794,279. As umbrellas become larger, the amount of mass that is required in the umbrella base for stability increases and 18 inch diameter round stands may weigh in excess of 50 pounds while cantilevered umbrellas of large size may require even a three foot square stand that could weigh in excess of 300 pounds.

While the use of such weighted stands provides a certain amount of mobility if provided with proper lifting equipment, the stands are neither inherently attractive nor useful without a lift trolley or wheels to enable the stand to be tilted and rolled to alternative locations. The present invention is designed to solve the mounting problem for outdoor umbrellas in providing a semi-permanent positioning technique that requires minimal installation effort, produces an attractive visual appearance, and allows for removal and relocation without seriously defacing previous mounting locations.

BRIEF SUMMARY OF THE INVENTION

A novel single pin mount and dome mechanism is provided to facilitate the semi-permanent location and mounting of umbrella poles. These and other aspects of the improved umbrella base design will become apparent in reviewing the drawings and detailed description of the invention.

DETAILED DESCRIPTION OF THE DRAWINGS

Figure 13:
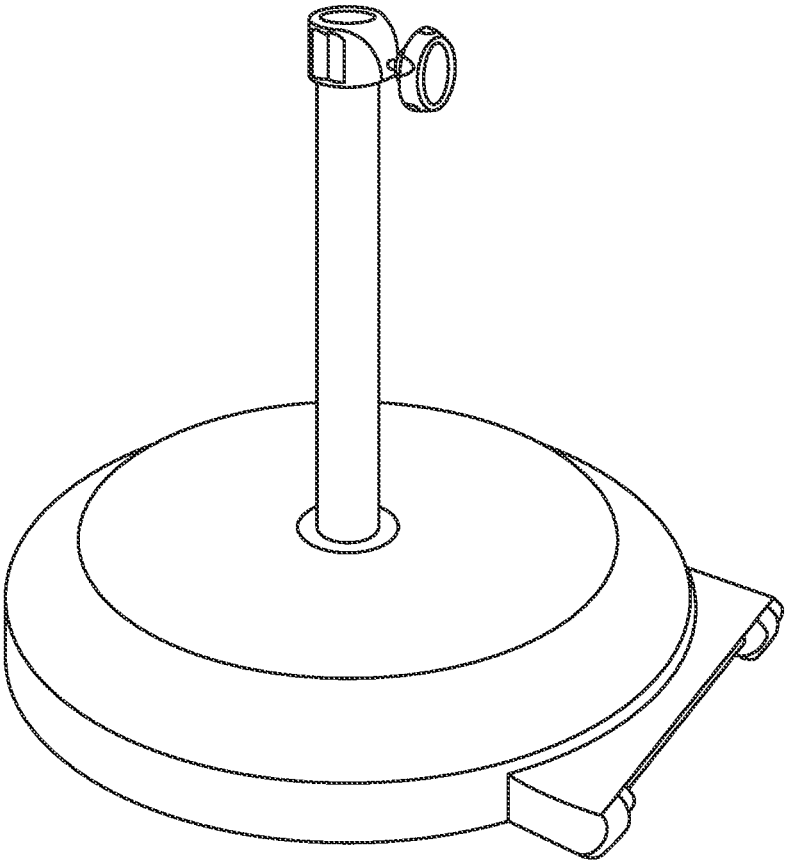
FIG. 13 (PRIOR ART)
FIG. 13 is a perspective view of an exemplary prior art wheeled umbrella base.

Turning initially to prior art umbrella base of FIG. 13, the typical fashion of dealing with outdoor mounted umbrellas is shown with a 75-pound concrete weight in the form of 18-21 inch diameter concrete disk covered in a powder coated metal shell with an upstanding receiver providing approximately an 18 inch sheath and tightening mechanism to receive a conventional 1¾ inch diameter umbrella base pole. The base is unsightly, particularly due to the addition of wheels. However, in the absence of wheels, the base is not particularly mobile. In either event, a 75 pound base is of limited stability in anything other than mild weather and only when used with smaller (5-7 foot diameter canopy) and vertically positioned umbrellas. Other prior art umbrellas, particularly intended for beach use, will have their bottom pole adapted to be driven into the sand. Larger outdoor umbrellas are often used for extended periods of time, as they are suitably employed to provide shade in fair weather. This leads to their use with relatively enormous base weights, as a component of larger pieces of furniture, or with entirely permanent mounting structures.

Figure 1:
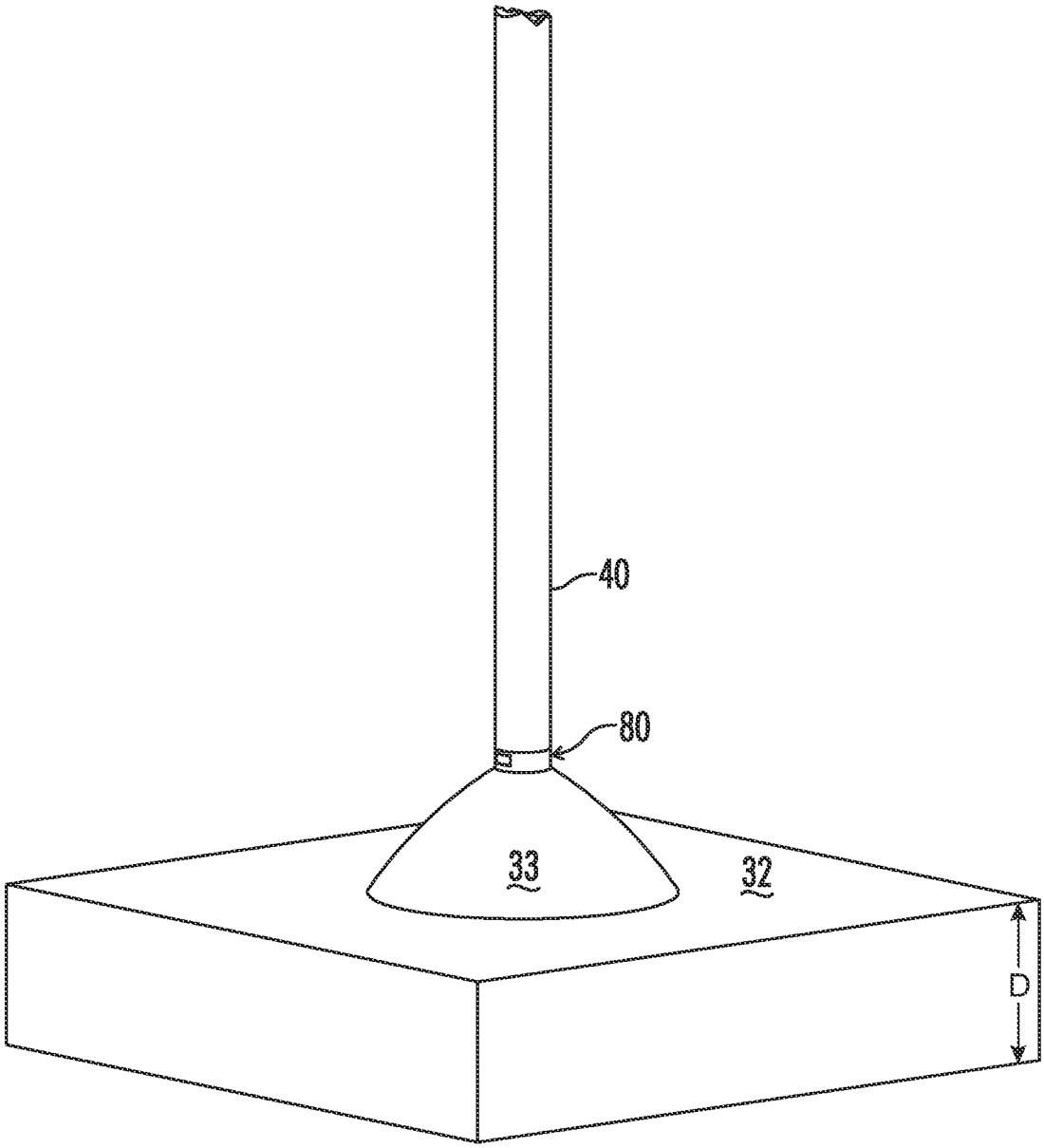
FIG. 1 is a perspective view of a section of concrete having a lower umbrella pole and assembled base according to the present invention.

An exemplary anchor pin mount according to the present invention is illustrated in its assembled form in FIG. 1. Notable illustrated components include a lower pole 40 of an umbrella. It will be understood that the lower pole 40 may extend all the way to the umbrella canopy or may be combined with an upper pole that is telescoping or cantilevered. Furthermore, the umbrella canopy may be permanently extended or adjustable with a variety of stretchers.

Below the lower pole 40 of the umbrella is visible a portion of a screw-in base 80, a support dome 33 with an outer circumference, and the surface to which the umbrella base is mounted 32.

The mounting surface 32 is preferably an expanse of concrete. The preferred concrete will be at least about 2-8 inches in depth D. Even greater depths of concrete are acceptable. Relatively short depths of concrete such as 2 or 3 inches may hinder the use of heavy duty pin supports according to the invention.

Figure 2:
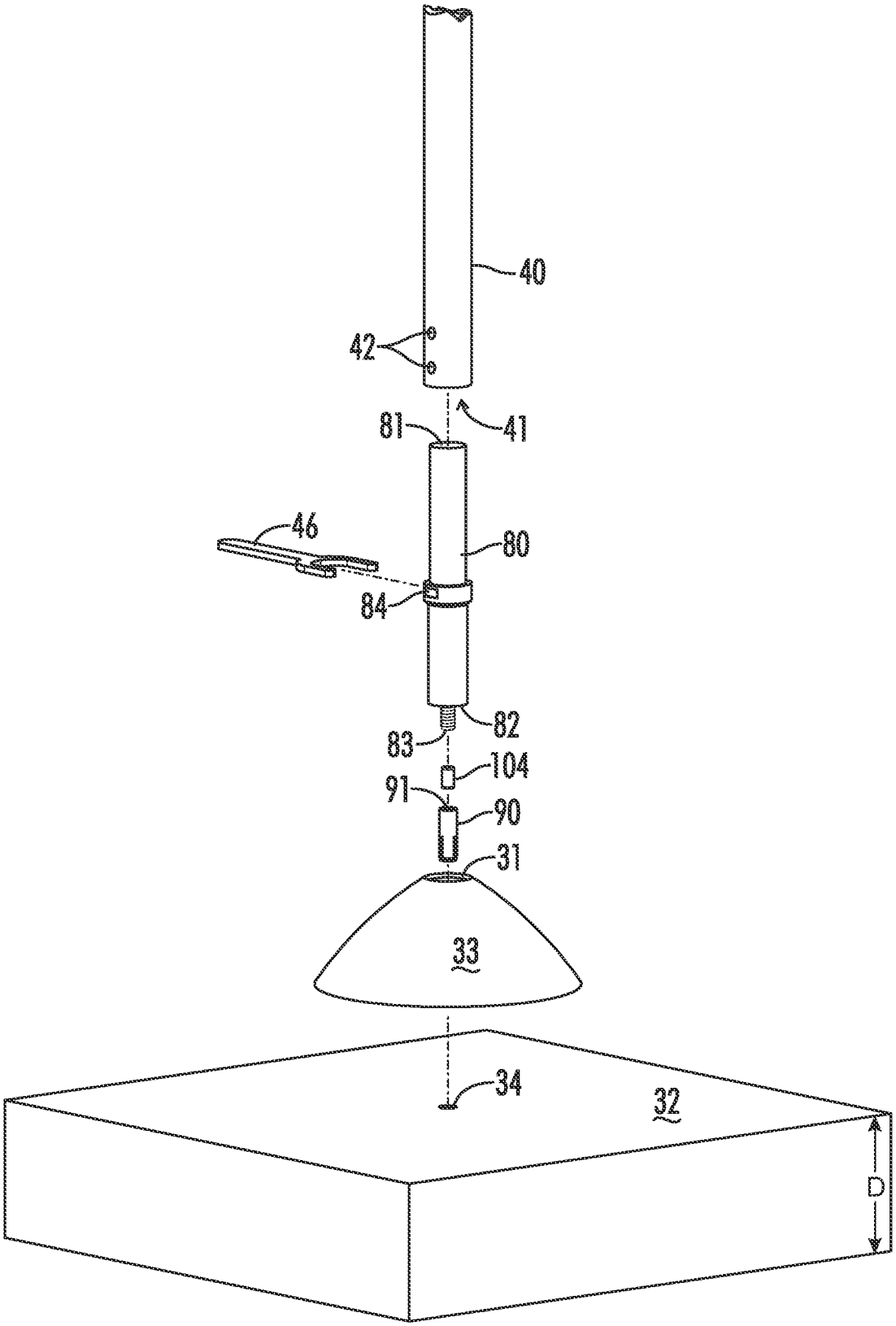
FIG. 2 is an exemplary exploded view of the lower pole and base of FIG. 1.

In FIG. 2 an exploded view is seen with lower base pole 40 having an interior lumen 41 that interfits over the upper portion 81 of screw-in base 80. Screw-in base 80 has opposed parallel planar surfaces 84 for convenient grasping by jaws of wrench 46. In addition, set screw 104 and drop in concrete anchor 80 are shown, and are to be received in the drilled opening 34 of the concrete surface 32. Dome 33 has a top opening 31 to receive the lower portion 82 of screw-in base 80.

Figure 3:
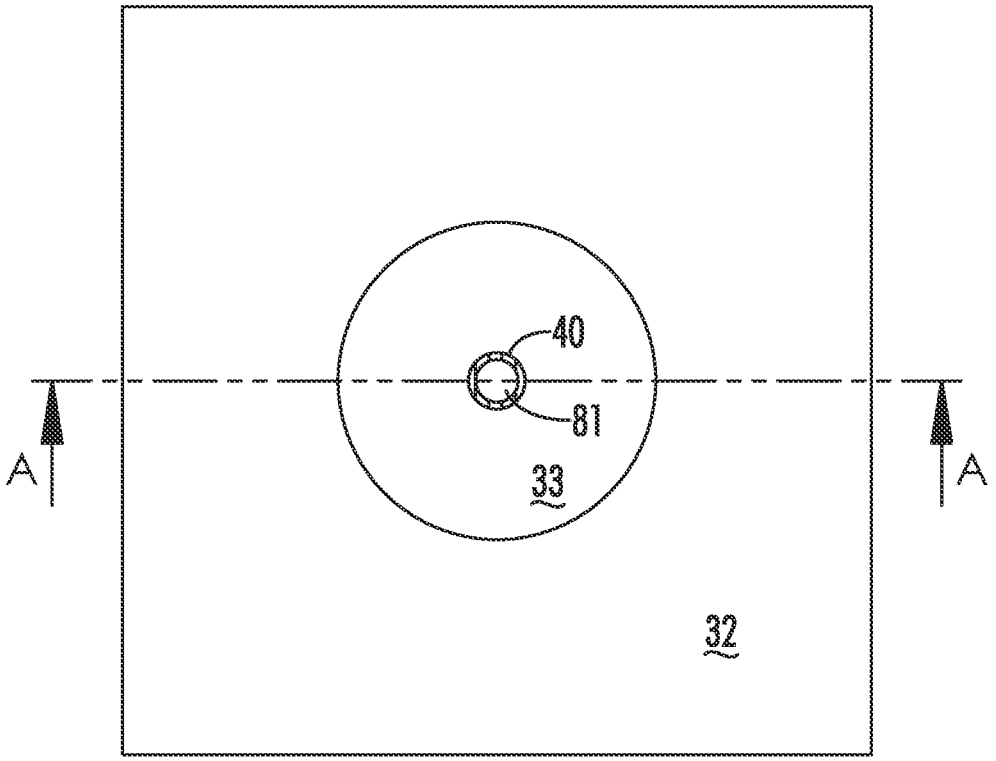
FIG. 3 is a top plan view of the lower pole and base of FIG. 1.

Turning then to FIG. 3 a top plan view of the umbrella base is shown having been taken in horizontal section through the lower pole 40. Interior of the lower pole 40 is a top 81 of the screw-in base 80, and exterior to lower portion 82 of screw-in base 80 is the dome 33 extending radially out over a portion of the mounting surface 32.

Figure 4:
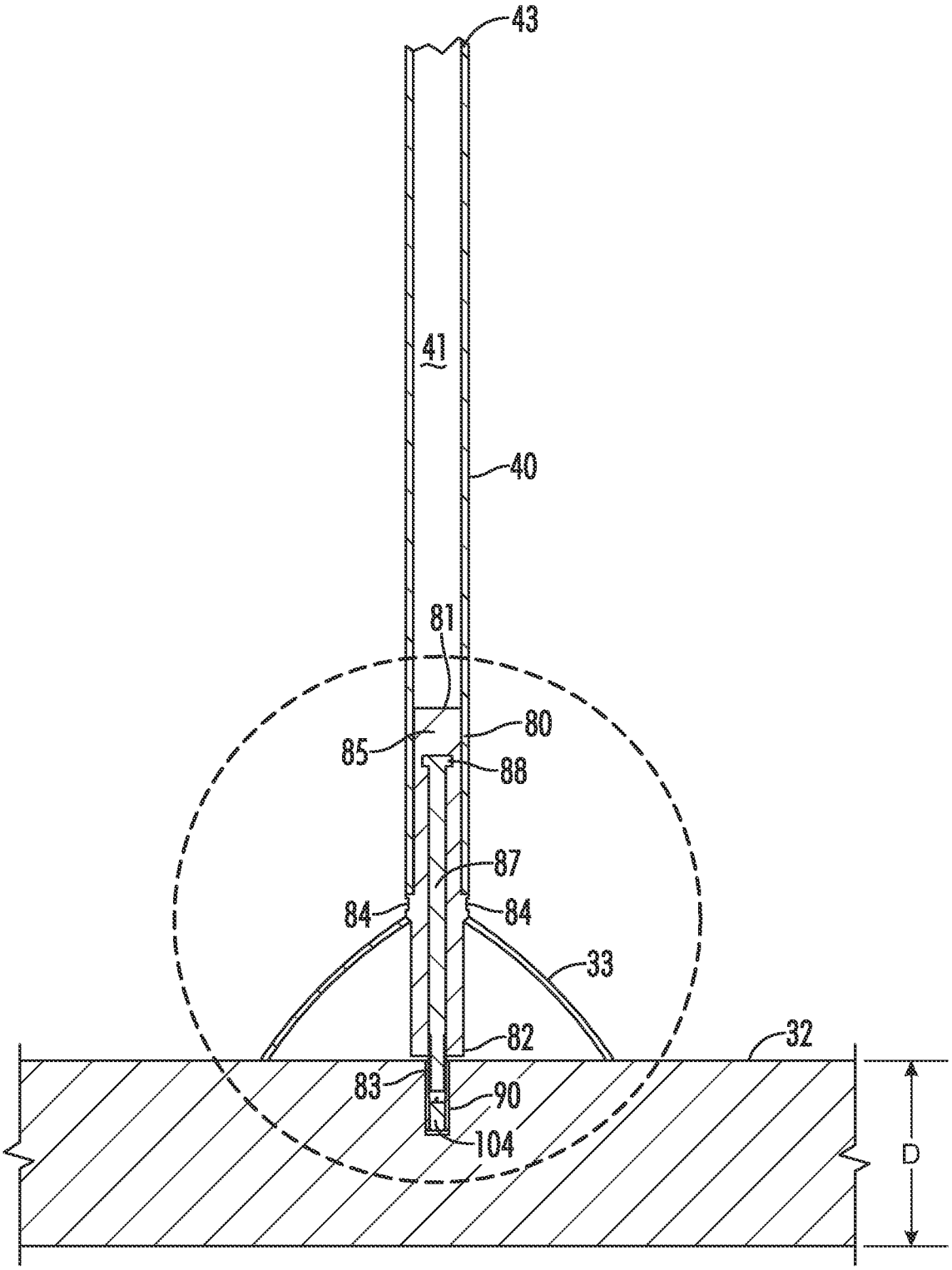
FIG. 4 is a sectional view taken along line A-A of FIG. 3.

FIG. 4 is a sectional view taken along the line A-A in FIG. 3. Illustrated in FIG. 4 is the wall 43 of lower pole 40 and interior lumen 41. The screw-in base 80 is preferably a molded material 85 around a bolt 87 having bolt head 88 and an opposite extending threaded end portion 83. The bolt 87 is secured within the molded material 85. High strength plastics may be preferred for molding purposes. Integrally formed screw-in bases may be used, however, there will generally be some increased cost or diminished strength in those constructions.

The anchor pin 90 is shown received into the opening in mounting surface 32, typically concrete having a 2-inch to 8-inch depth D. The depth D should be at least about 4.5 times the nominal diameter of the anchor pin 90. The depth D should also preferably exceed the length of the anchor pin 90.

Figure 5:
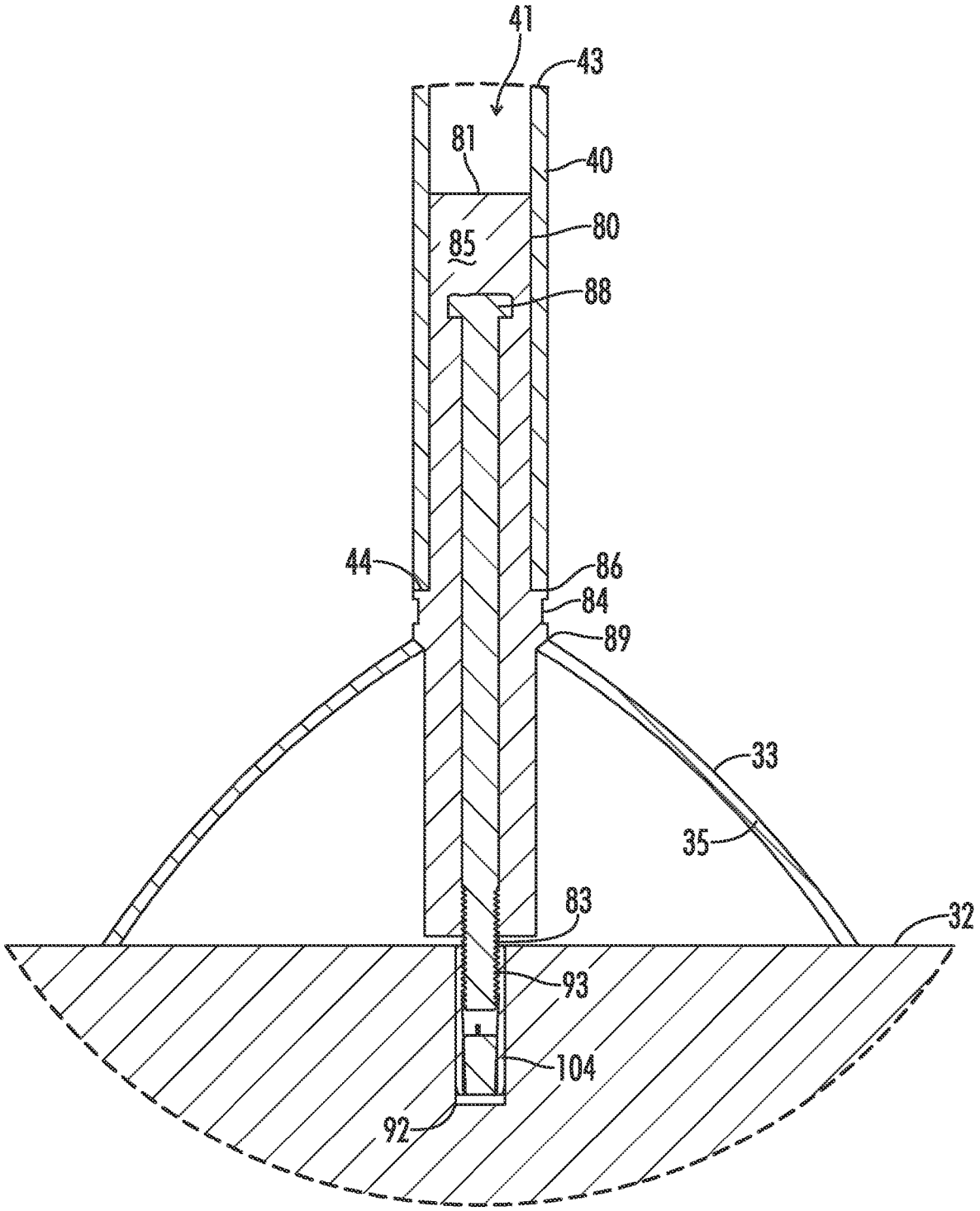
FIG. 5 is an enlarged view of the dashed line circle of section of FIG. 4.
Figure 6:
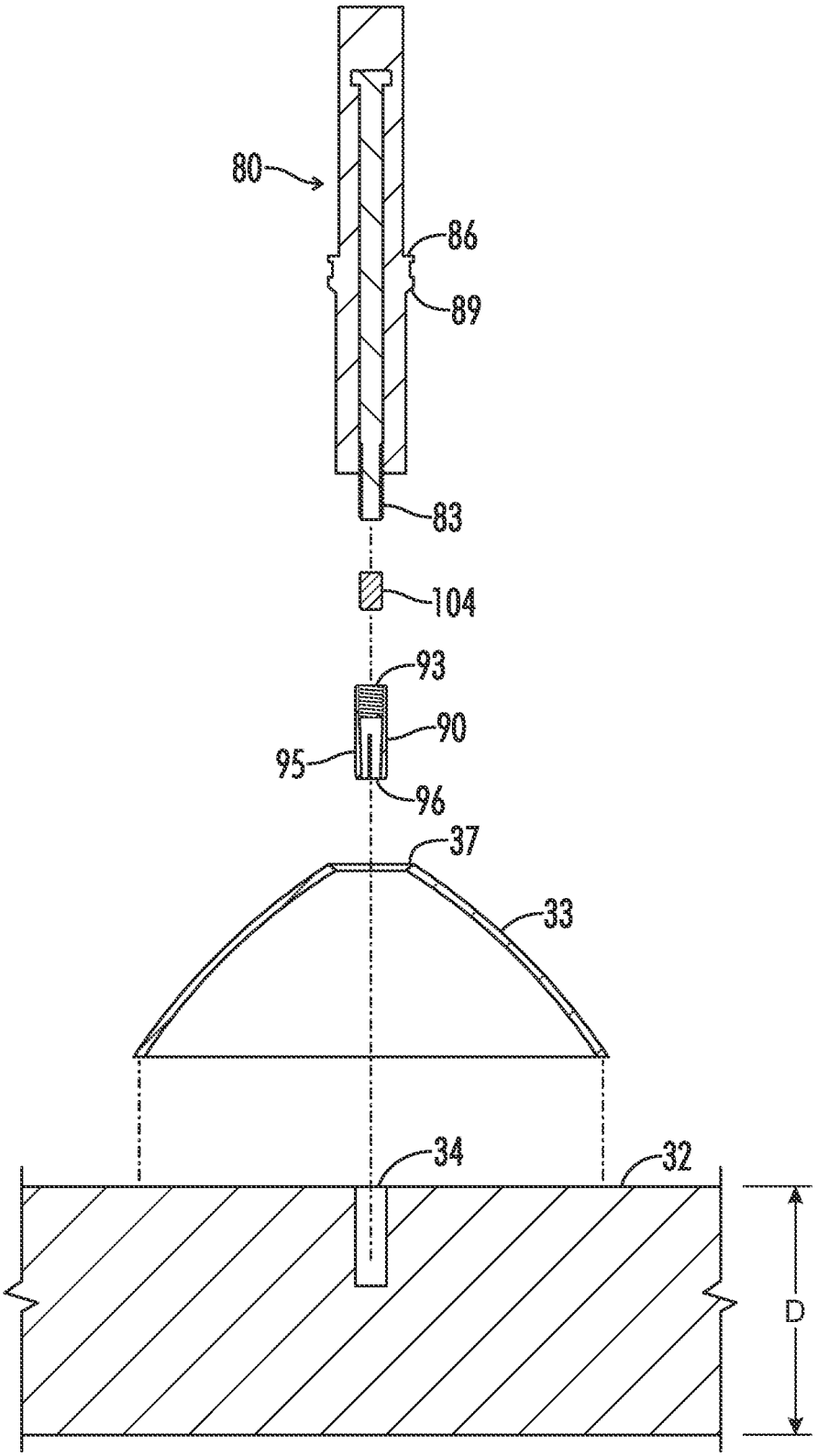
FIG. 6 is an exploded view of the components of FIG. 5.

FIG. 5 is an exploded view of the dashed circle portion of FIG. 4 illustrating again the top end 81 of screw-in base 80 being received within lumen 41 of lower umbrella pole 40. The bottom edge 44 of pole 40 rests upon top flange 86 on the intermediate portion of the screw-in base 80. Parallel and planar sidewalls 84 of the intermediate portion of screw-in base 80 permit grasping by jaws of a wrench for rotation. Angled lower flange surface 89 of screw-in base 80 interfaces with interior edge surface 37 of a top opening 31 in the center of dome 33. In typical construction, the width of dome shell 35 may be about 3 to 4 millimeters, typically of die cast aluminum. It will be understood that other suitable materials having appropriate strength, weight, and appearance may be used. The shell of the dome preferably extends from an outer perimeter that rests on the mounting surface in an upward and inwardly progressing curve to a central upper opening 31. While a curved and continuous dome surface is preferred for appearance and to shield the anchor pin 90 from weather, other constructions of the web between the outer perimeter and central upper opening are possible, particularly if a collar and reinforcing ribs are used as shown in the dome structure of FIG. 14. The drop-in anchor 90 is received in an opening 34 of the mounting surface 32 and fixed by the placement of set screw 104. Threaded portion 83 of the bolt 88 molded into the screw-in base 80 is rotationally attached to interior threads 93 of the drop-in anchor 90.

FIGS. 6-11 show the sequential assembly of the base according to the illustrated embodiment of the invention. Initially, an opening 34 is prepared in the base surface 32. In a typical case for installing a residential umbrella, a half-inch diameter drop-in anchor 90 can be used so that a ⅝-inch hole is drilled in a concrete surface 32 to an appropriate depth. The appropriate depth typically being about 2.5 inches in this case, but ultimately can depend upon the precise size of the drop-in anchor 90 being used, which in turn may depend on the pull-out strength needed for a particular installation. A rotational hammer drill is often used for drilling in concrete.

Figure 7:
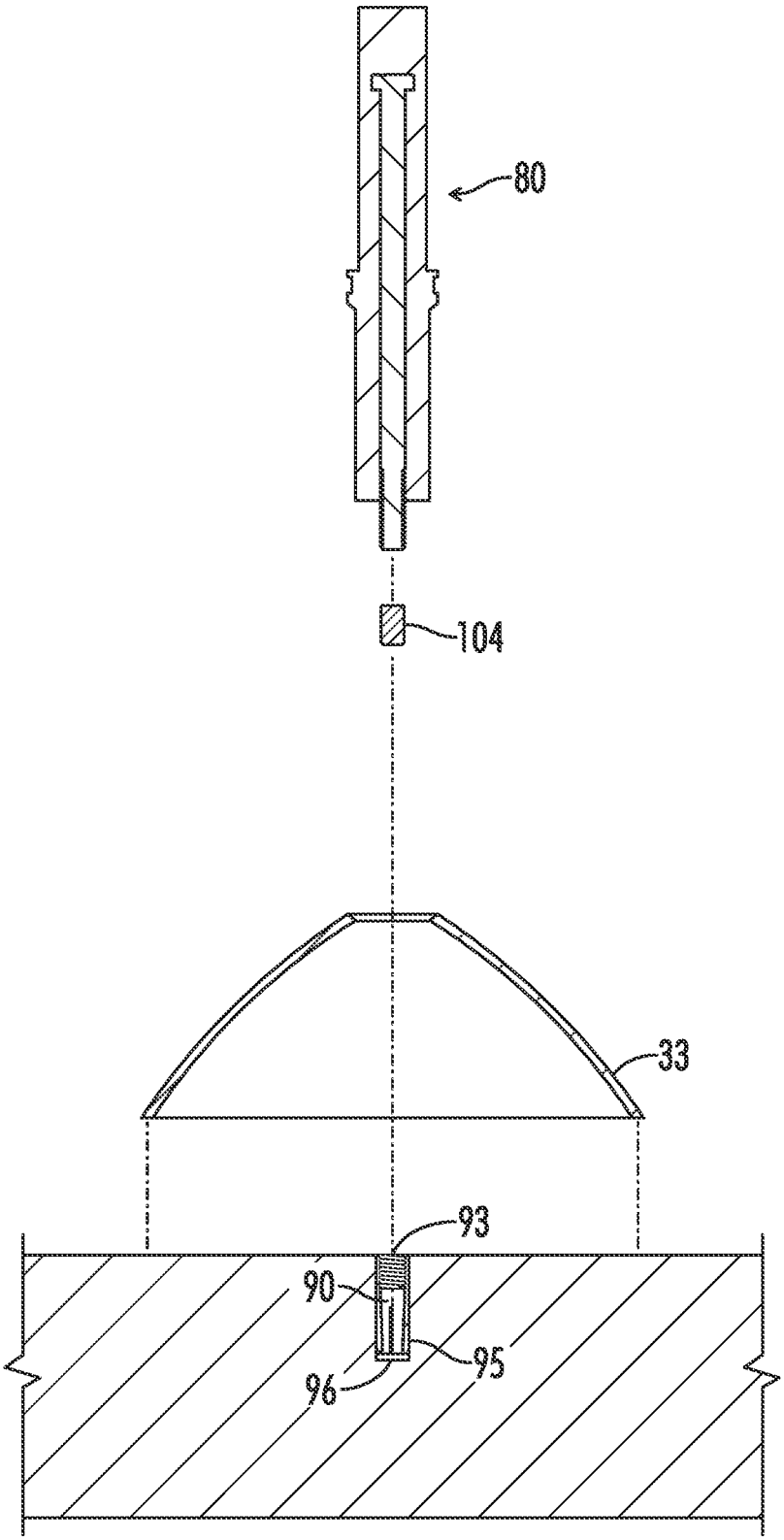
FIG. 7 is an exploded view of the components of FIG. 5 showing the positioning of a drop-in anchor.

Once the opening 34 is prepared, the drop-in anchor 90 is placed in the opening as shown in FIG. 7. The bottom 96 of the anchor 90 may rest at the bottom of the opening 34. A lower portion 95 of the anchor is typically formed of split sections that can be expanded outward and that have gnarled or braided exterior for frictional purposes. The interior of at least the upper portion of the anchor 93 is threaded. Expansion anchors and undercut anchors are generally preferred anchor designs.

Figure 8:
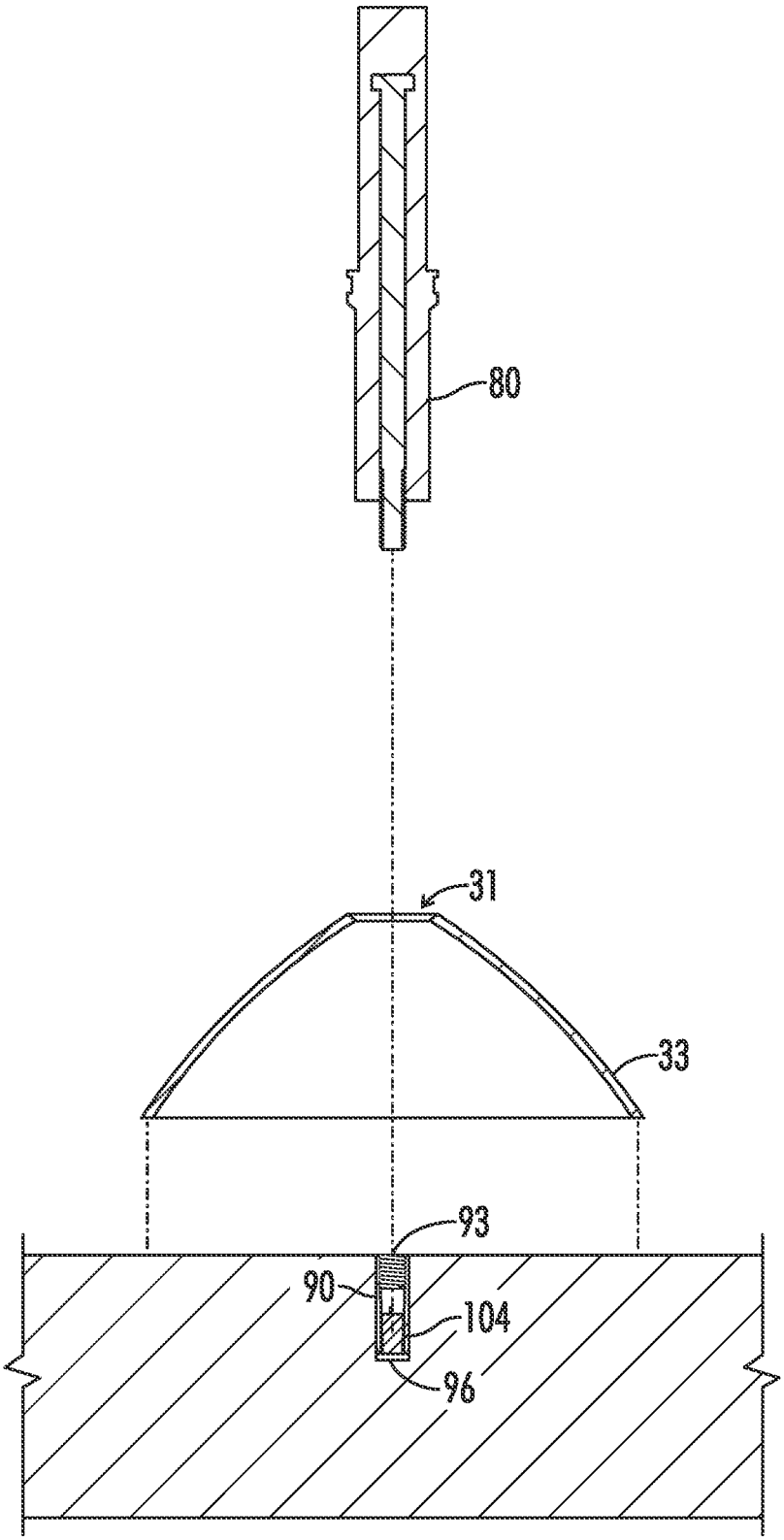
FIG. 8 is an exploded view of the components of FIG. 5 showing the positioning of the drop-in anchor and set screw.

Turning then to FIG. 8, the set screw 104 has been positioned to the bottom of anchor 90. Set screw 104 may either be rotationally fit into the lumen 91 of the anchor 90 or alternatively may be hammered into position. The movement of set screw 104 toward the bottom 96 of anchor 90 causes the gnarled or braided outer lower portion 95 of the anchor to expand and tightly grip the interior walls of the opening 34 or in appropriate cases to form an undercut.

A table showing exemplary pull-out strengths of various dimensions and depths of mounting for drop-in anchors is reflected below so that it can be seen a typical half-inch diameter drop-in anchor should be embedded in at least 2 inches of concrete. A half-inch diameter anchor is actually sized with an exterior of approximately ⅝ inch diameter, so that size drill bit is necessary to form the opening 34 in concrete surface 32.

| Size | Minimum Embedment | Drill Bit | Pull-Out (lbs.) |
|---|---|---|---|
| ¼" | 1" | ⅜" | 939 |
| ⅜" | 1 9/16" | ½" | 1560 |
| ½" | 2" | ⅝" | 3105 |
| ⅝" | 2½" | ⅞" | 3323 |
| ¾" | 3 3/16" | 1" | 6678 |

When mounted in 2000 psi concrete, even to a depth of only 2-2½ inches, a half-inch anchor can provide over 3000 pull-out pounds of strength. However, the anchors should not be mounted too close to the edge of concrete and typically a distance from the edge of at least five times the diameter of the anchor is preferred. Because outdoor applications are typical for umbrellas, anchors 90 are preferably fabricated of stainless steel or hot dipped galvanized steel to provide some corrosion resistance.

Figure 9:
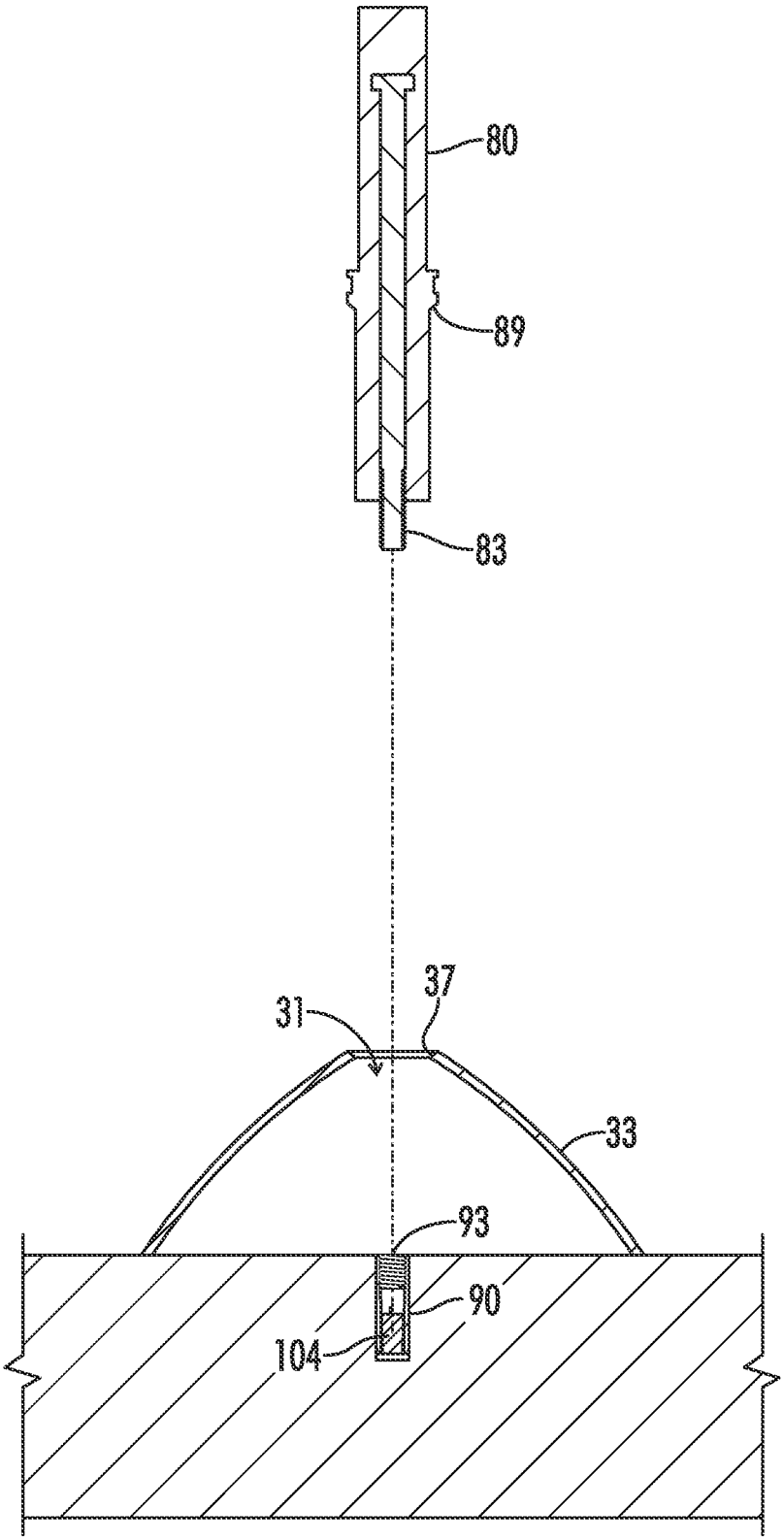
FIG. 9 is an exploded view of the components of FIG. 5 showing the positioning of the drop-in anchor, set screw, and dome.

Once the anchor 90 is positioned and set, the dome 33 is placed centrally over the anchor as shown in FIG. 9. Dome 33 preferably has an interior central opening 31 having an inward edge with an upwardly and outwardly angled face 37. The dome 33 also protects the anchor 90 from being totally exposed to sun and moisture and may retard their corrosive effects.

Figure 10:
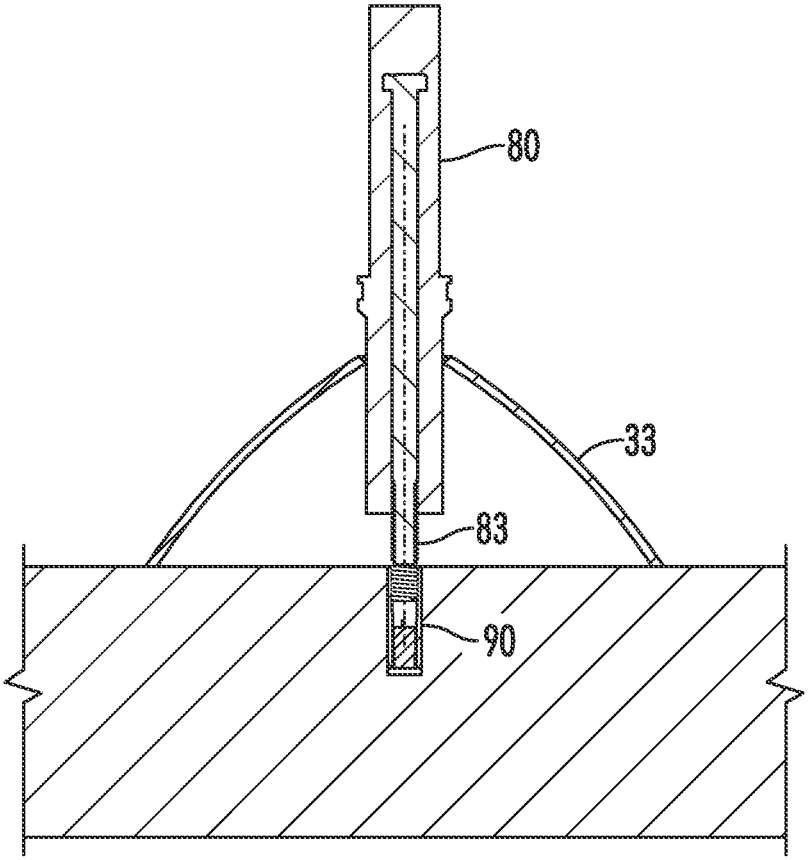
FIG. 10 is an exploded view of FIG. 5 showing the positioning of the drop-in anchor, set screw, dome, and initial positioning of a screw-in base.

As reflected in FIG. 10, the screw-in base 80 is then placed into the opening 31 of the dome 33 and aligned so that the threaded end 83 of the screw-in base will enter the threaded upper portion 93 of the drop-in anchor 90.

Figure 11:
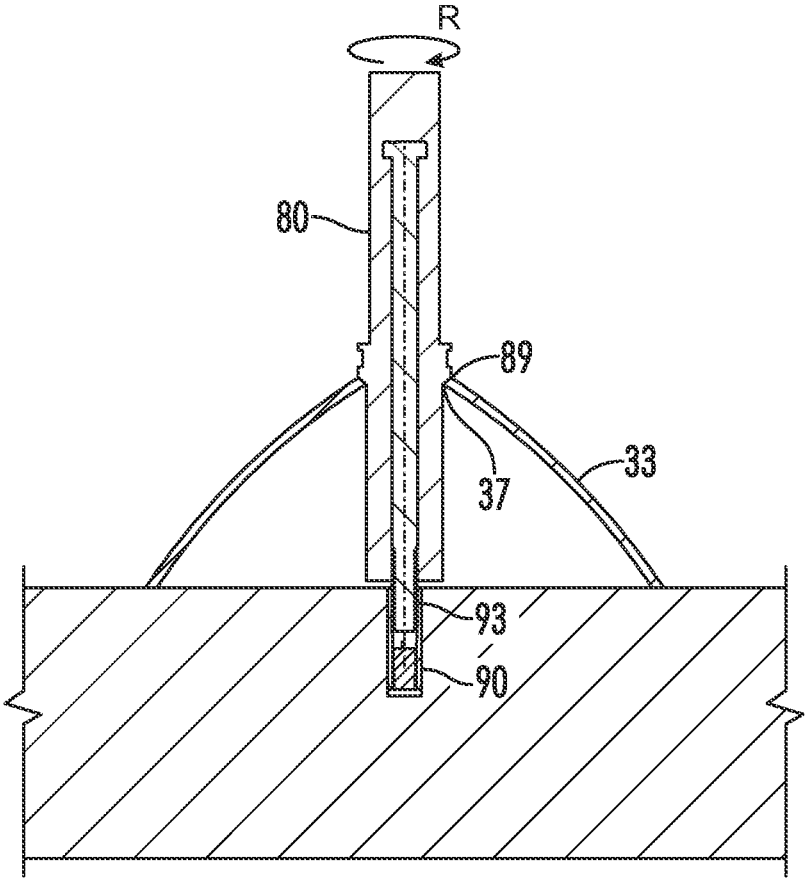
FIG. 11 is a view of the components of FIG. 5 showing the rotational attachment of screw-in base.

FIG. 11 reflects the rotation R used to secure the threaded end 83 of the screw-in base 80, and shows the interface of angled lower flange 89 against outwardly angled interior edge surface 37 of dome 33. The interface between upward surface 37 and downward flange 89 provides lateral support to the vertically positioned screw-in base 80. The rotation R of screw-in base 80 causes the threaded end 83 to be received within the threaded interior 93 of the drop-in anchor 90.

Figure 14:
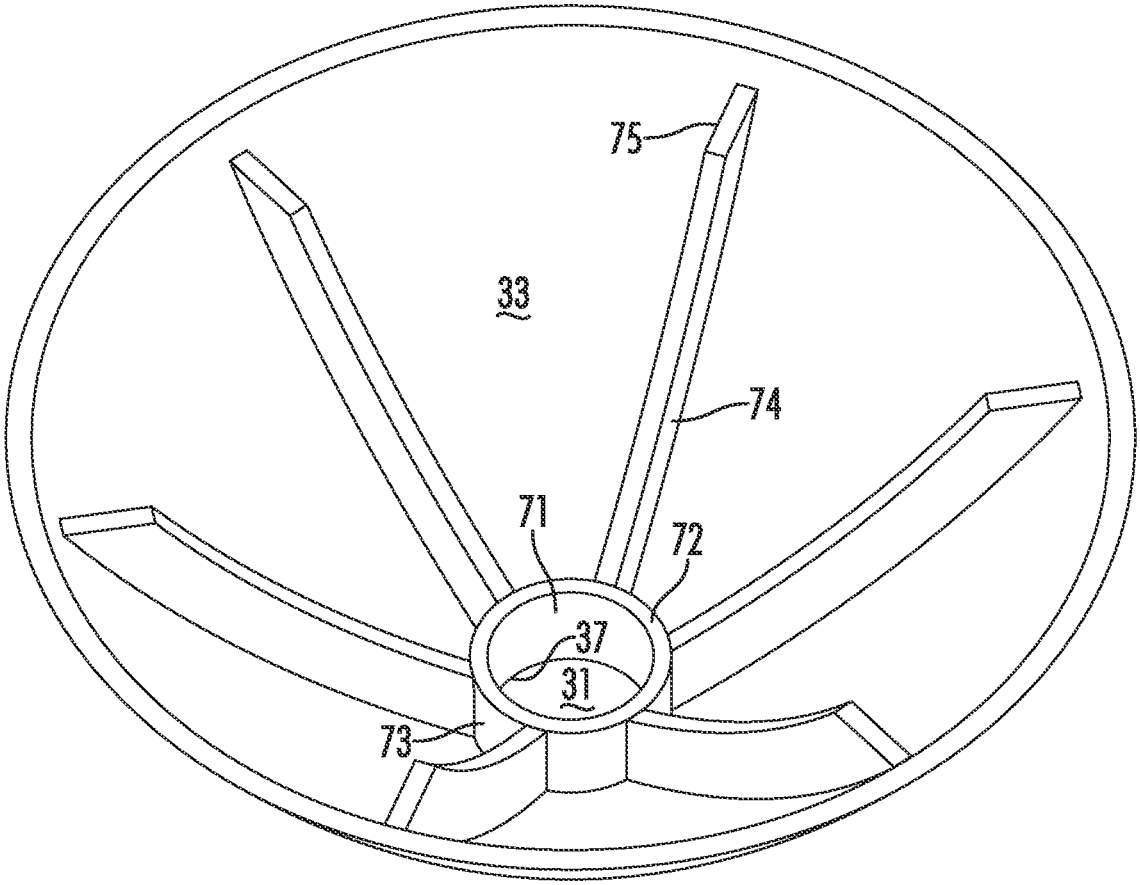
FIG. 14 is a bottom perspective view of a preferred reinforced dome structure.

A preferred dome structure is shown in FIG. 14. In the structure, the interior of the dome 33 is fitted or integrally formed with a collar and support ribs. The illustrated collar is cylindrical with an inner surface 71 extending downward from the angled interior edge surface 37 of the opening 31 of the dome 33. The inner surface 71 may taper slightly from top-to-bottom, so that the largest diameter is proximate the angled edge 37. The collar extends downward from the angled edge 37 to its bottom 72, and has an outer surface 73. Extending from the outer surface 73 are a plurality of support ribs 74 that have opposite ends 75 flush with the outer periphery of the dome 33.

The lower portion 82 of the screw-in base 82 may also be slightly tapered to match the taper of inner surface 71. Thus, the lower portion 82 proximate the angled lower flange 89 has a slightly greater diameter and narrows to match the taper of the inner surface 71 of the collar. In this fashion, the interface between the angled lower flange 89 and angled interior edge surface 37 position the screw-in base 82. As the screw-in base 82 is tightened, the larger interface between the inner surface 71 of the collar and the lower portion 82 that is preferably formed of a moldable material 85 with a slight resilience, create a snug friction fit that is resistant to any material movement.

Furthermore, the formation or fitting of support ribs 74 extending between the collar and the outer periphery of the dome 33 provides increased resistance to deformation by potentially immense forces acting on the pole 40. The ends 75 of support ribs 74 may also better distribute forces on the mounting surface 32. The weight and cost of about 5-12 support ribs 74, and preferably about 6-8 support ribs, is significantly less than increasing the thickness of the entire dome 33 to provide equivalent rigidity.

Figure 12:
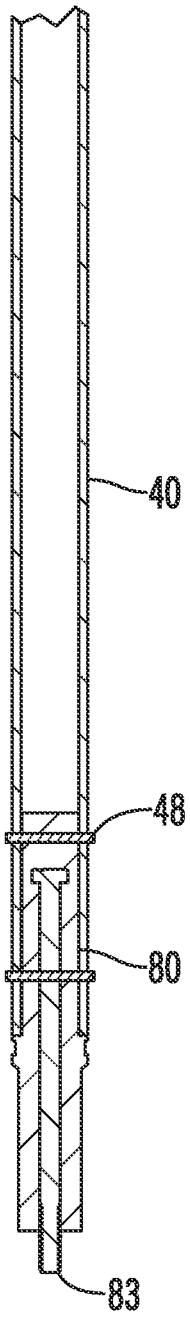
FIG. 12 is a sectional view of the umbrella base pole and screw-in base attached with cross-pins.

The lower pole 40 may also be prepared with openings 42 shown in FIG. 2 on opposite sides to receive pins 48 as shown in FIG. 12 passing through the upper portion of the screw-in base 80. The placement of such a pin fixes the lower umbrella pole 40 upon the screw-in base 80, and resists both removal and rotation of the lower pole.

If desired to remove a mounted umbrella, the umbrella and lower pole 40 may be unpinned and taken off the top 81 of the screw-in base 80. The screw-in base 80 can be unscrewed and removed along with the dome 33. Then anchor 90 can then be filled with a socket head cap-screw and the previous umbrella location will have a nearly flush surface and appear small and unremarkable.

Surprisingly, the height of the dome need not be as large as the receptacles on many prior art umbrella pole bases. For instance, the wheeled encased concrete base of FIG. 13 generally had a weighted disc portion about 3.5 to 4 inches in height and another 14-15 inch receiver pole extending upwards. However, when using a dome 33 in connection with an anchor 90, a six-inch diameter dome 33 having a height of only about three inches provides extraordinary resistance to deflection in moderate or even heavy wind. A dome 33 having a nine-inch diameter and a height of about 4-5 inches provides even greater resistance and can be used with large canopies (9 foot diameters) and cantilevered umbrellas.

More commonly in vertically bracing, bracing structures extend upward to a midpoint or even higher on a wall or post to be supported. However, because the dome 33 of the present design provides support to all sides of the screw-in base 80, the relatively low 3-5 inch positioning of the support from the outwardly sloping face 37 of top opening 31 of the dome 33, has an effect as substantial as providing support at a higher location in only one, two, or three different specific directions, as would be the case with guy wires. Thus, the interface of outwardly sloping surface 37 on the dome 33 with the angled lower flange surface 89 of the screw-in base 80 around the 360° circumference of the screw-in base 80 means that compression support from the wall 35 of the dome 33 is always directed exactly in the direction against the forces acting on the umbrella pole. Also, because the lower pole 40 is overfitting the top 81 of the screw-in base 80, the diameter of the pole is not reduced and the lower pole retains the cylindrical strength of the larger diameter, relative to the case if the lower pole 40 were sized to fit within a receiver on the base. The result is a surprisingly compact, attractive, and strong umbrella pole base.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

I claim:

1. An anchored umbrella base comprising:

a threaded anchor socket set in a mounting surface;

a dome having an outer base circumference supported by the surface and a wall structure extending upward and inward to an opening in the top, the opening defining an opening edge, and said dome being placed above the threaded anchor socket;

a screw-in base having a lower threaded end engaged in the anchor socket;

said screw-in base having an upper end extending outward above the opening in the top of the dome for receiving a lower umbrella pole;

wherein the opening edge of the dome fits against an intermediate portion of the screw-in base and the screw-in base is formed of plastic molded around a metal bolt with a lower threaded end of the bolt forming the lower threaded end of the screw-in base.

2. The anchored umbrella base of claim 1 wherein the screw-in base has a flange at a top of the intermediate portion and a bottom end of the lower umbrella pole rests upon the flange when the lower umbrella pole overfits the upper end of the screw-in base.

3. The anchored umbrella base of claim 2 wherein the lower umbrella pole has opposed openings that align with an opening passing through the upper end of the screw-in base, and a pin passing through these openings secures the lower umbrella pole to the screw-in base.

4. The anchored umbrella base of claim 1 wherein the intermediate portion of the screw-in base has a flange with a downward sloping side that rests upon an upward sloping surface of the opening in the top of the dome.

5. The anchored umbrella base of claim 4 wherein a collar having a downwardly tapering inner surface extends downward from the opening in the top of the dome, and a lower portion of the screw-in base below the flange tapers downward.

6. The anchored umbrella base of claim 1 wherein the intermediate portion of the screw-in base has a pair of opposed planar sides.

7. The anchored umbrella base of claim 1 wherein the dome further comprises at least five support ribs extending on the wall structure between the outer base circumference and the opening in the top.

8. A method of mounting an umbrella on an anchored base comprising the steps of:

making an opening in a mounting surface to receive an anchor;

inserting a threaded anchor in the opening;

securing the anchor in the opening;

placing a dome with a top center opening over the anchor;

inserting a threaded bottom of a screw-in base through the top center opening of the dome;

rotating the screw-in base so that the threaded bottom engages in the threaded anchor;

continuing to rotate the screw-in base until an intermediate flange of the screw-in base fits snugly with an interior edge of the top center opening of the dome; and placing a lower umbrella pole on a top portion of the screw-in base extending upward from the intermediate flange;

wherein the intermediate flange of the screw-in base has a downward sloping side that fits against an upward sloping interior surface of the top center opening of the dome.

9. The method of mounting an umbrella of claim 8 wherein the intermediate flange of the screw-in base has a portion above the top center opening of the dome with opposed planar sides that are rotated with the jaws of a wrench.

10. The method of mounting an umbrella of claim 8 wherein the mounting surface is concrete and the anchor is secured in the opening by using a set screw.

11. The method of mounting an umbrella of claim 8 wherein the lower umbrella pole has opposed openings that align with an opening passing through the upper end of the screw-in base, and a pin is passed through these openings to secure the lower umbrella pole to the screw-in base.

12. The method of mounting an umbrella of claim 8 wherein the intermediate flange of the screw-in base has a top and a bottom end of the lower umbrella pole rests upon the top of the intermediate flange when the lower umbrella pole overfits the top portion of the screw-in base.

13. The method of mounting an umbrella of claim 8 wherein the opening in the mounting surface is between 2 inches and 6 inches in depth.

14. The method of mounting an umbrella of claim 8 wherein the dome has a height of less than 6 inches and has an outer perimeter resting on the mounting surface that is less than 12 inches in diameter.

15. A method of mounting umbrella on an anchored base comprising the steps of:

making an opening in a mounting surface to receive an anchor;

inserting a threaded anchor in the opening;

securing the anchor in the opening;

placing a dome with a top center opening over the anchor;

inserting a threaded bottom of a screw-in base through the top center opening of the dome;

rotating the screw-in base so that the threaded bottom engages in the threaded anchor;

continuing to rotate the screw-in base until an intermediate flange of the screw-in base fits snugly with an interior edge of the top center opening of the dome; and placing a lower umbrella pole on a top portion of the screw-in base extending upward from the intermediate flange; wherein the top center opening has a downwardly extending collar with a downwardly tapering inner surface, and the screw-in base has a lower section downwardly tapering below a downward sloping side of the intermediate flange.

16. The method of mounting an umbrella of claim 15 wherein the lower section has a plastic molded surface and rotating the screw-in base causes the plastic molded surface of the lower section to frictionally engage the tapering inner surface of the collar.

17. The method of mounting an umbrella of claim 15 wherein the intermediate flange of the screw-in base has a portion above the top center opening of the dome with opposed planar sides that are rotated with the jaws of a wrench.

18. The method of mounting an umbrella of claim 15 wherein the mounting surface is concrete and the anchor is secured in the opening by using a set screw.

19. The method of mounting an umbrella of claim 15 wherein the lower umbrella pole has opposed openings that align with an opening passing through the upper end of the screw-in base, and a pin is passed through these openings to secure the lower umbrella pole to the screw-in base.

20. The method of mounting an umbrella of claim 15 wherein the dome has a height of less than 6 inches and has an outer perimeter resting on the mounting surface that is less than 12 inches in diameter.

* * * * *